US006374840B1

(12) United States Patent
Ma

(10) Patent No.: US 6,374,840 B1
(45) Date of Patent: Apr. 23, 2002

(54) CORDLESS PATIO UMBRELLA

(75) Inventor: Oliver Joen-An Ma, Arcadia, CA (US)

(73) Assignee: Treasure Garden, Inc., Baldwin Park, CA (US)

( * ) Notice: Subject to any disclaimer, the term of this patent is extended or adjusted under 35 U.S.C. 154(b) by 0 days.

(21) Appl. No.: 09/585,975

(22) Filed: Jun. 2, 2000

(51) Int. Cl.[7] ..... A45B 25/14; A45B 25/16
(52) U.S. Cl. ..... 135/22; 135/23; 135/98
(58) Field of Search ..... 135/22, 23, 29, 135/98

(56) References Cited

U.S. PATENT DOCUMENTS

| | | | | | |
|---|---|---|---|---|---|
| 521,222 | A | * | 6/1894 | Schof et al. | 135/22 |
| 620,815 | A | * | 3/1899 | Warren | 135/29 |
| 928,169 | A | * | 7/1909 | Bardon | 135/22 |
| 1,001,076 | A | * | 8/1911 | Redford | 135/29 |
| 1,207,649 | A | * | 12/1916 | South | 135/22 |
| 1,908,453 | A | * | 5/1933 | Schmidt | 135/22 |
| 2,185,466 | A | * | 1/1940 | Jostes | 135/22 |
| 2,474,516 | A | * | 6/1949 | Daniel | 135/29 |
| 2,705,967 | A | * | 4/1955 | Zimmermann et al. | 135/22 |
| 2,860,647 | A | * | 11/1958 | Negri | 135/29 |
| 2,906,277 | A | * | 9/1959 | Militano | 135/22 |
| 3,016,910 | A | * | 1/1962 | Rosenkaimer | 135/22 |
| 3,672,381 | A | * | 6/1972 | Kida et al. | 135/22 |
| 5,483,985 | A | * | 1/1996 | Yu | 135/22 |
| 5,842,493 | A | * | 12/1998 | Yakubisin | 135/29 |
| 6,039,063 | A | * | 3/2000 | Lin et al. | 135/29 X |
| 6,076,540 | A | * | 6/2000 | You | 135/22 |
| 6,095,169 | A | * | 8/2000 | Lin et al. | 135/29 X |

* cited by examiner

*Primary Examiner*—Robert Canfield
(74) *Attorney, Agent, or Firm*—Raymond Sun

(57) ABSTRACT

A patio umbrella has a pole, a plurality of primary ribs extending from the pole, a hub slidably supported on the pole, and a plurality of secondary ribs, each secondary rib having a first end pivotally coupled to the hub and a second end pivotally coupled to one of the primary ribs. The patio umbrella has a ledge positioned on the pole, and a spring slidably supported on the pole between the hub and the ledge. The patio umbrella can also have at least one stretcher having a first end pivotally coupled to one of the secondary ribs, and a second end pivotally coupled to the ledge.

12 Claims, 5 Drawing Sheets

CORDLESS PATIO UMBRELLA

BACKGROUND OF THE INVENTION

1. Field of the Invention

The present invention relates to outdoor and patio umbrellas, and in particular, to a spring and stretcher system for use with outdoor and patio umbrellas.

2. Description of the Prior Art

Outdoor and patio umbrellas (hereinafter referred to collectively as patio umbrellas) have become increasingly popular, due to newly found uses and applications. Patio umbrellas have traditionally provided shade from sunlight in patios, backyards, swimming pools and other play or recreation facilities.

Recently, hotels, resorts, and restaurants have also taken advantage of the shade protection of these umbrellas for their guests and have become major purchasers. In particular, patio umbrellas will usually see extended usage in tropical countries and other warm weather resort areas.

In order to be used outdoors safely, patio umbrellas must carry enough weight to provide the necessary stability against the elements. However, most patio umbrellas are typically heavy, bulky, and large in size, which makes them somewhat inconvenient to store and transport.

In order to be used outdoors, patio umbrellas must be durable, safe, and easy to use. Many patio umbrellas employ a pulley and cord to open and to close the umbrella. However, because the cord rubs and chafes against the pulley, the fibers of the cord eventually fray and disintegrate. In addition, with this wear and tear, even the pulley mechanisms have a tendency to wear out from the constant rubbing of the metal parts and from the force applied from the pulling of the cord. Thus, after extended normal use, both the pulley and rope mechanisms may become defective or break.

Given their size and weight, breakage of any part of the umbrella may compromise the stability of the entire umbrella structure. Any breakage could also possibly lead to the dangerous collapse of the umbrella upon those people who are positioned under the umbrella.

Even if the breakage does not compromise the stability and safety, it can still be troublesome and expensive to either (1) repair the umbrella, or (2) replace the pulley system, or (3) dispose of or replace the old umbrella with a new one, especially if the repair and replacement is required on a regular basis.

In addition, having to pull a cord to open and close a large and bulky patio umbrella is inconvenient and time consuming. More importantly, this task requires the exertion of a large amount of force, which is something that certain people (e.g., young children, some women, and some senior citizens) will have find great difficulty in doing. To these people, this exertion of force can even pose health dangers.

Thus, there remains a need to provide a patio umbrella that has increased durability, maximizes safety, and is easy to use.

SUMMARY OF THE DISCLOSURE

It is an object of the present invention to provide a patio umbrella that is convenient to open and to close.

It is another object of the present invention to provide a patio umbrella that minimizes the possibility of breakage of any of its components.

It is yet another object of the present invention to provide a patio umbrella that does not require the use of a cord and pulley system.

To accomplish the objects of this invention, there is provided a patio umbrella having a pole, a plurality of primary ribs extending from the pole, a hub slidably supported on the pole, and a plurality of secondary ribs, each secondary rib having a first end pivotally coupled to the hub and a second end pivotally coupled to one of the primary ribs. The patio umbrella has a ledge positioned on the pole, and a spring slidably supported on the pole between the hub and the ledge. When one of the primary ribs of the umbrella is lifted, the spring will bias the umbrella into an opened position. The umbrella can be closed by compressing the spring, and maintained in the closed position by restraining the spring in its compressed position.

In one embodiment of the present invention, the patio umbrella has at least one stretcher having a first end pivotally coupled to one of the secondary ribs, and a second end pivotally coupled to the ledge.

In another embodiment of the present invention, the patio umbrella further includes covers for the spring.

DETAILED DESCRIPTION OF THE PREFERRED EMBODIMENTS

The following detailed description is one of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides a novel spring and stretcher system that allows the user to open and close the umbrella without using a pulley and cord. When one of the long ribs of the umbrella is lifted, the spring will bias the umbrella into an opened position. The umbrella can be closed by compressing the spring, and maintained in the closed position by restraining the spring in its compressed position.

Figure 1:
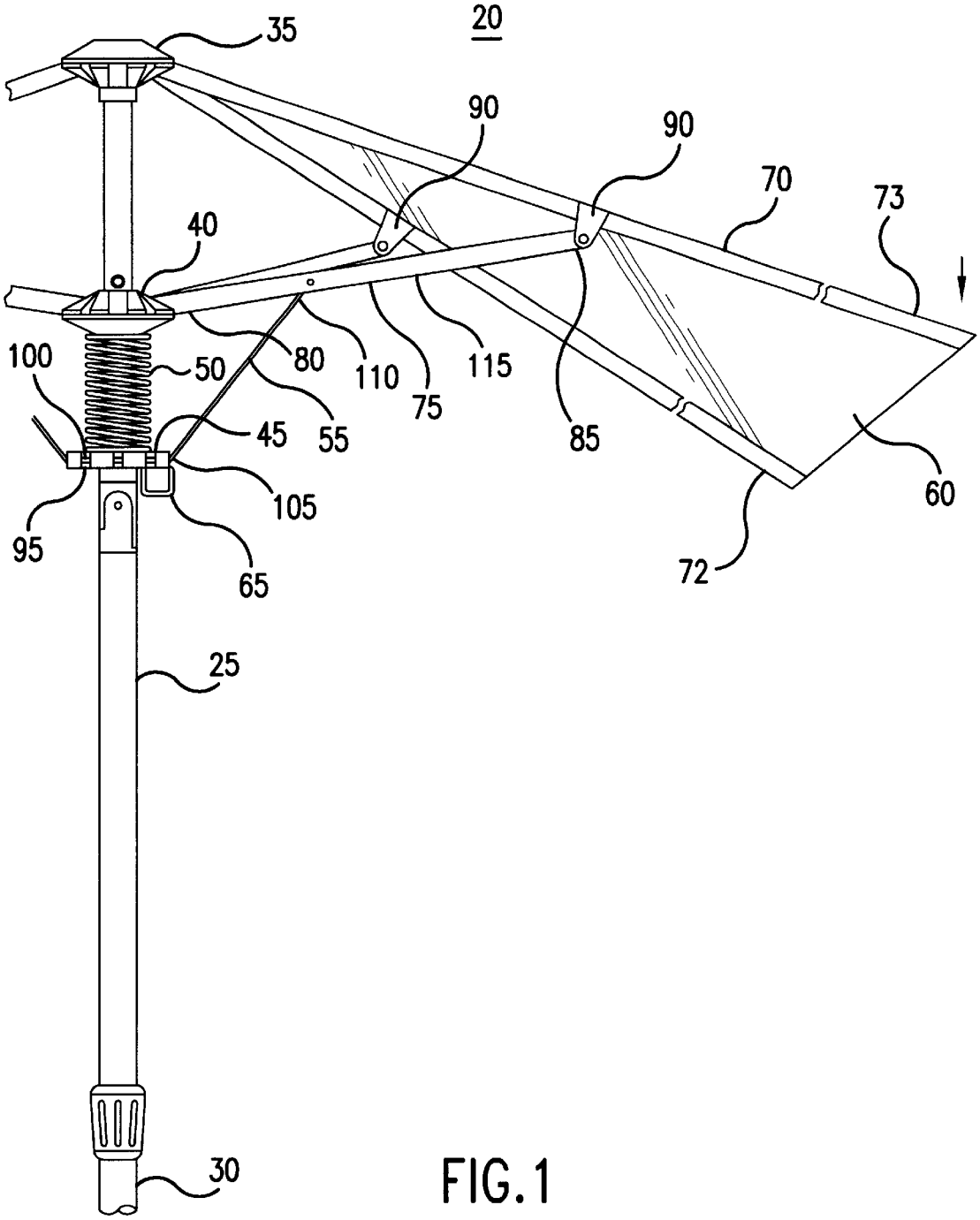
FIG. 1 is a side view of a portion of the patio umbrella according to one embodiment of the present invention shown in an open position.

FIG. 1 illustrates the skeletal frame for a patio umbrella 20 according to the present invention. The umbrella 20 has a pole 25 having a lower end 30 that is adapted to be inserted into the bore of a conventional umbrella base (not shown). The umbrella 20 also includes a hub and runner system that is provided adjacent to the top of the pole 25. The hub and runner system includes an upper hub 35 that is permanently fixed or secured to the top of the pole 25, and a lower hub 40 that is adapted to slide along a portion of the vertical length of the pole 25 below the upper hub 35.

Figure 2:
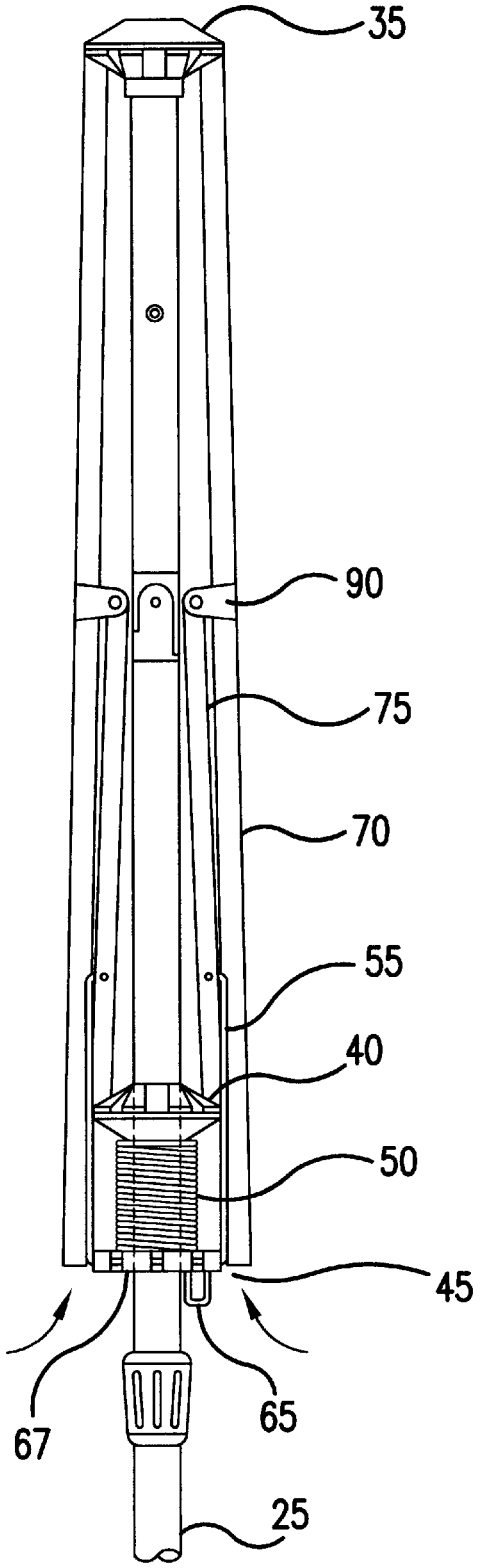
FIG. 2 is a side view of the patio umbrella of FIG. 1 shown in a closed position.

The umbrella 20 further includes a plurality of long ribs 70 extending radially from the upper hub 35 for supporting an umbrella covering 60. Additionally, there are a plurality of short ribs 75, each of which has an inner end 80 and an outer end 85. The inner end 80 of each short rib 75 is pivotally connected to and extends radially from the lower hub 40. The outer end 85 of each short rib 75 is connected to a pivoting connection 90 which is positioned between the opposing ends of the long rib 70. FIGS. 1 and 2 illustrate one non-limiting example for this connection 90, and it will be appreciated by those skilled in the art that it is possible to provide this connection 90 using any other conventional mechanism or joint. For example, the outer end 85 of each short rib 75 can be coupled to a corresponding long rib 70 by rivets.

Referring to FIGS. 1 and 2, a spring 50 is positioned between the lower hub 40 and an annular ledge 45. The pole 25 extends through the spring 50, and the spring 50 can be left unattached, between the lower hub 40 and the annular ledge 45. In one embodiment, the spring 50 can be composed of a durable, metallic substance. The annular ledge 45 has a plurality of generally rectangular channels 95, which are provided in a spaced-apart manner around the annular ledge 45. Each of these channels 95 has a connection bar 100. The annular ledge 45 provides a lower resting surface for the lower end of the spring 50. A handle 65 can be provided along the bottom side 67 of the ledge 45.

Figure 7:
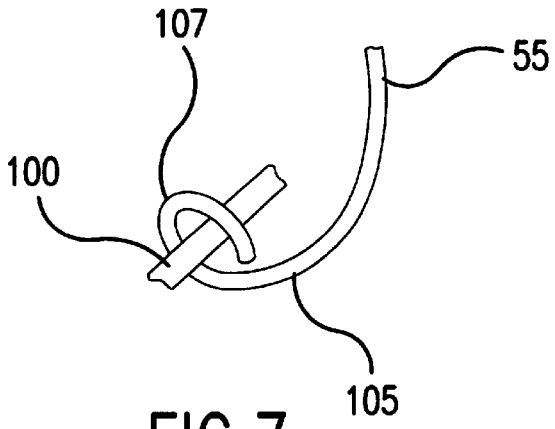
FIG. 7 is a view of the connection mechanism of one stretcher and the annular ledge of the patio umbrella in FIG. 1.
Figure 5:
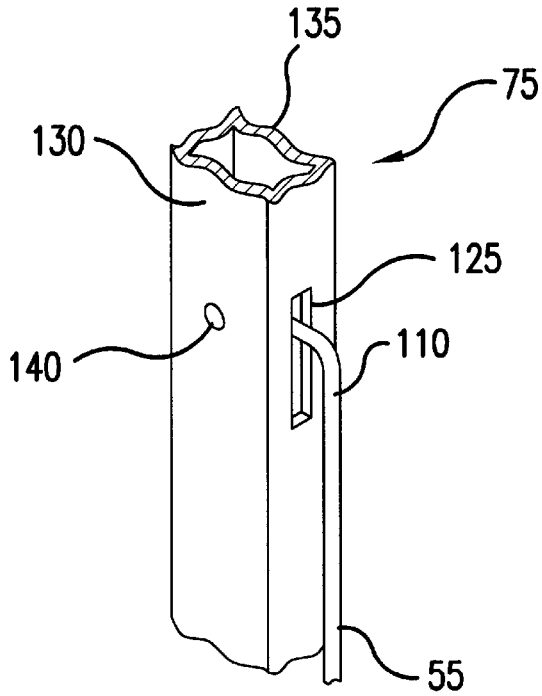
FIG. 5 is a perspective view of a portion of the connection mechanism of one stretcher and one rib of the patio umbrella in FIG. 1.
Figure 6:
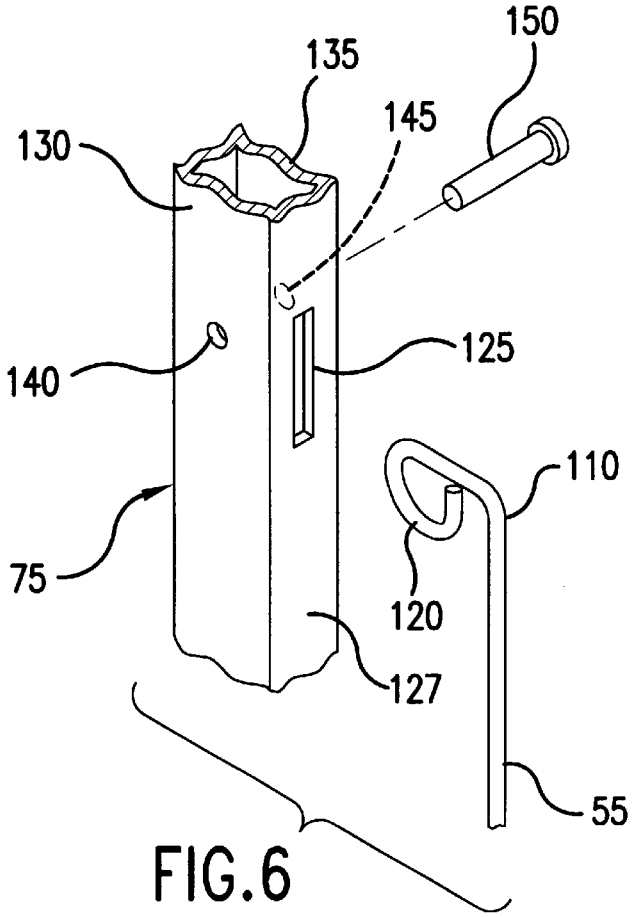
FIG. 6 is an exploded perspective view of the connection mechanism of FIG. 5.

The umbrella 20 also includes a plurality of stretchers 55. The stretchers 55 can be made of any sturdy material, such as a metallic material. Each stretcher 55 has an inner end 105 and an outer end 110. The outer end 110 of each stretcher 55 is pivotally coupled with the body 115 of a corresponding short rib 75, as shown in FIGS. 5 and 6. The inner end 105 of each stretcher 55 is pivotally coupled to one connection bar 100 on the annular ledge 45, as shown in FIG. 7. Thus, each stretcher 55 extends radially from annular ledge 45 to the body 115 of a short rib 75, and lifts or supports the annular ledge 45 to prevent the annular ledge 45 from sliding vertically downwardly.

Referring to FIGS. 5 and 6, the outer end 110 of each stretcher 55 has a closed circular loop 120, which is adapted to fit into a rectangular slot 125 along a side 127 of the body 115 of a corresponding short rib 75. On the two opposing sides 130 and 135 of the short rib 75 that are perpendicular to the side 127, there are two holes 140 and 145, respectively, which lie opposite to, but are aligned with, one another to accommodate a locking pin or rivet 150, which is adapted to be inserted through the closed circular loop 120. Thus, the stretcher 55 can pivot with respect to the short rib 75 at a pivot point defined by the axis created by the locking pin or rivet 150.

Referring now to FIG. 7, the inner end 105 of each stretcher 55 has a generally closed circular loop 107 that loops around a corresponding connection bar 100 on the annular ledge 45. Thus, the connection bar 100 is retained inside the opening of the loop 107, so that the stretcher 55 can pivot with respect to the annular ledge 45 at a pivot point defined by the axis created by the connection bar 100.

Figure 8:
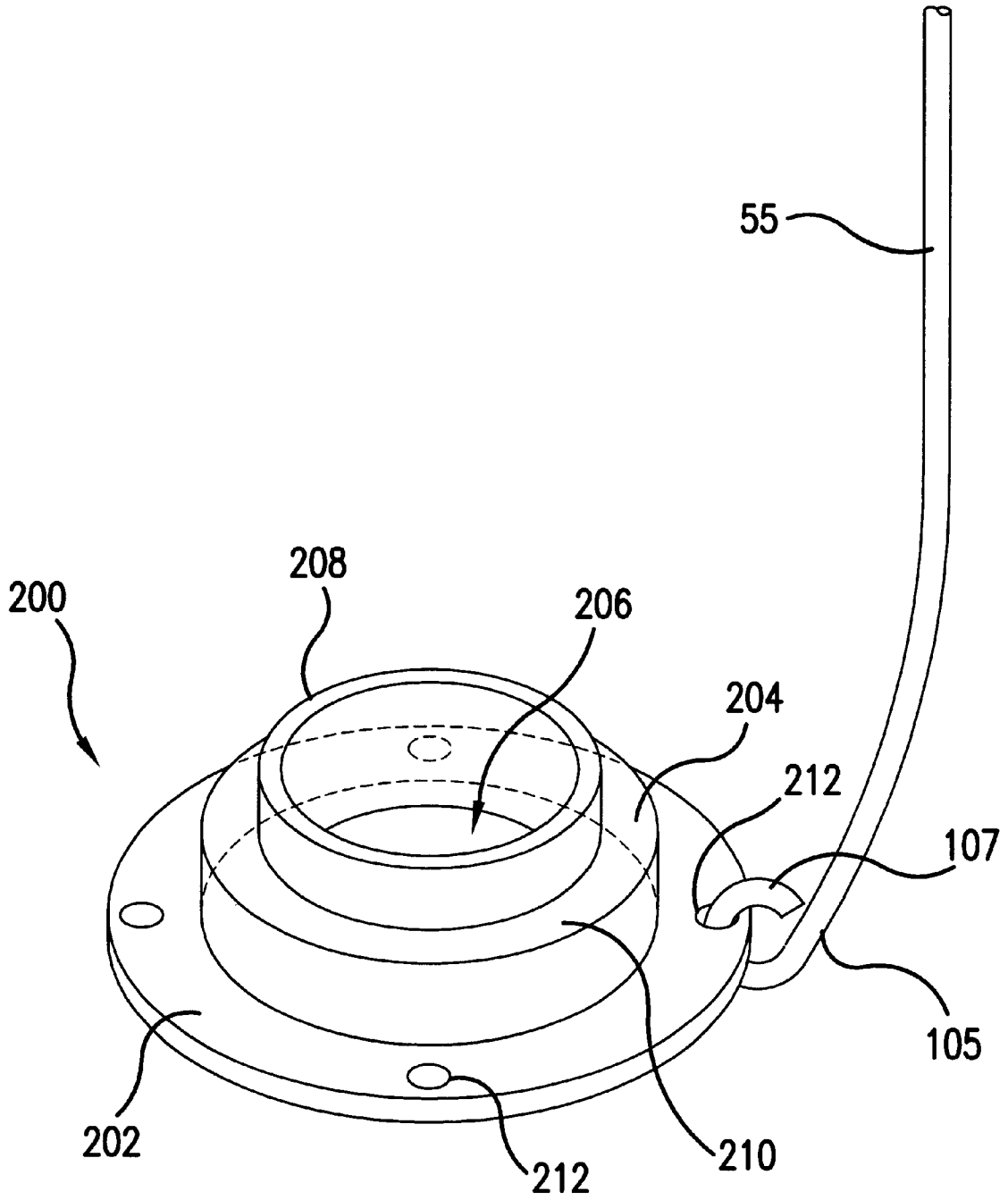
FIG. 8 illustrates an annular ledge according to an alternative embodiment of the present invention.

FIG. 8 illustrates another possible embodiment for the annular ledge 200. The annular ledge 200 has a base plate 202 with a raised platform 204 provided about the center of the base plate 202. A bore 206 extends through the center of the base plate 202 and the platform 204, and the pole 25 is adapted to be slidable through the bore 206. An annular wall 208 extends from the top surface 210 of the platform 204 at the location of the bore 206, so that the pole 25 can slide through the annular wall 208. Thus, the spring 50 is adapted to be seated on the top surface 210 of the platform 204, with the annular wall 208 acting as a guide for positioning the spring 50. In addition, a plurality of openings 212 are provided in spaced apart manner about the periphery 214 of the base plate 202. Each opening 212 is adapted to receive the loop 107 of the inner end 105.of a respective stretcher 55 to form a pivoting connection between the annular ledge 200 and the stretcher 55.

Referring to FIGS. 1 and 2, the spring 50 and the stretcher 55 operate to open and close the umbrella 20. First, when the umbrella 20 is in its closed position as shown in FIG. 2, the stretchers 55 are disposed in a generally vertical orientation where each stretcher 55 is generally parallel to the pole 25. This orientation of the stretchers 55 allows the stretchers 55 to counteract or oppose the bias of the spring 50, thereby keeping the spring 50 compressed and the umbrella 20 in the closed position.

To open the umbrella 20, the user applies an upward force to the bottom side 72 of one of the long ribs 70 to cause the stretchers 55 to be moved from their vertical orientation. This releases the force that keeps the spring 50 compressed, so that the spring 50 now automatically biases the lower hub 40 upwardly along the pole 25 without any further user intervention. The bias (i.e., extension) of the spring 50 will also cause the spring 50 and the annular ledge 45 to advance vertically upwardly along the pole 25. As the lower hub 40 moves upwardly along the pole 25, the short ribs 75 are moved radially outwardly towards a generally horizontal orientation, thereby opening the umbrella 20 into the open position shown in FIG. 1.

To close the umbrella 20, the user applies a downward force to the top side 73 of one or more of the long ribs 70, so as to push the short ribs 75 radially inward, which in turn causes the lower hub 40 to be pushed downward along the pole 25. This overcomes the bias of the spring 50, and causes the spring 50 and the annular ledge 45 to advance vertically downwardly along the pole 25. When the long ribs 70 are pushed down until they are generally parallel with the pole 45, the stretchers 55 are disposed in the generally vertical orientation in the closed position of FIG. 2. To apply the downward force, the user can also employ the handle 65 to pull down on the annular ledge 45, or pull down on the base plate 202 of the annular ledge 200.

Thus, the deployment and closing of the umbrella 20 is very simple, and requires little force or strength on the user's part. A small upward force is all that is needed to open the umbrella 20, and the user can watch as the spring 50 does the rest of the work that is needed to open the umbrella 20. To close the umbrella 20, the user only needs to corral the long ribs 70 and to push them down against the bias of the spring 50 (or merely pull down on the handle 65 or base plate 202). The vertical orientation of the stretchers 55 provides an effective self-locking mechanism which does not require any other separate locking device or mechanism to hold the umbrella 20 in the closed position.

Figure 3:
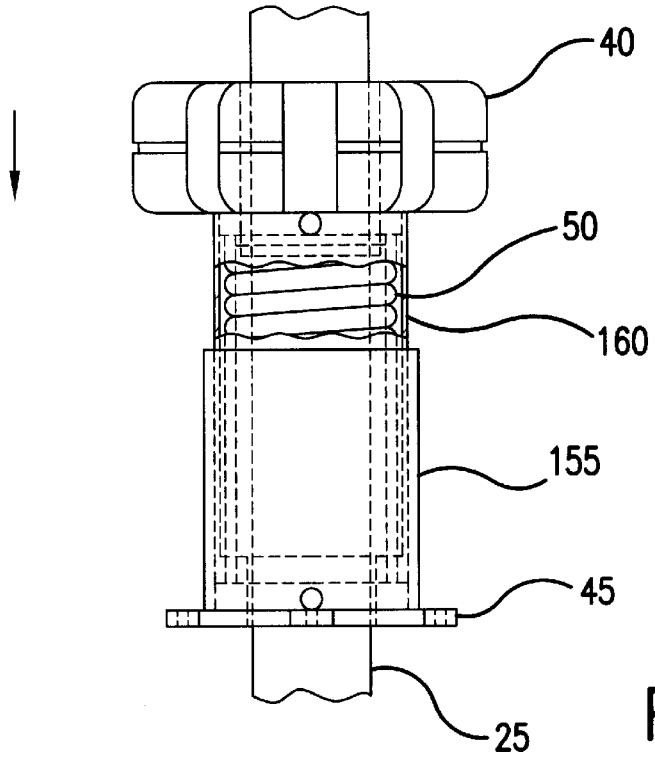
FIG. 3 is a cross-sectional view of the compressed spring mechanism according to another embodiment of the patio umbrella.
Figure 4:
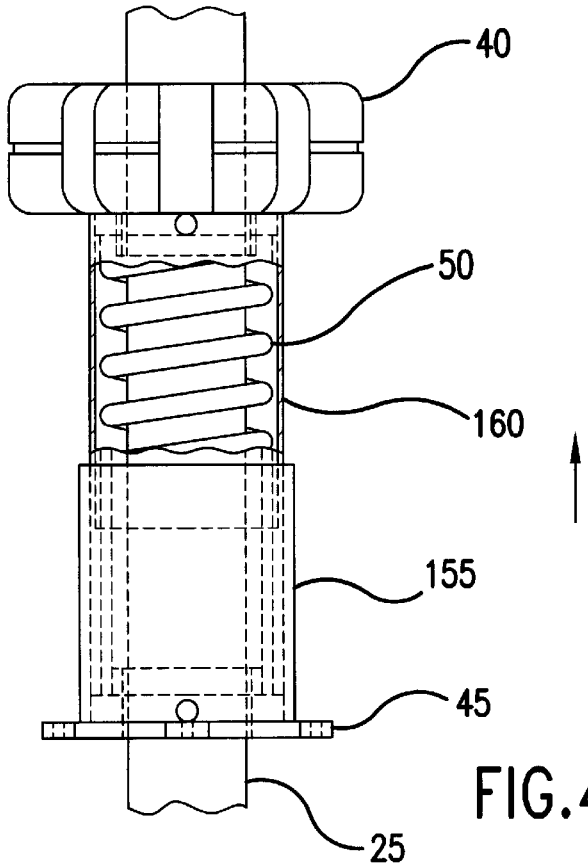
FIG. 4 is a cross-sectional view of the spring mechanism of FIG. 3 in a non-compressed position.

Referring to FIGS. 3 and 4, another embodiment of the present invention employs covers for the spring 50. In this embodiment, there are two overlapping covers: a lower spring cover 155, which is attached to the annular ledge 45, and an upper spring cover 160, which is attached to the lower hub 40. The lower cover 155 overlaps the upper cover 160 when the spring 50 is compressed. In other words, when the spring 50 is compressed, the lower cover 155 slides over the upper cover 160. When the spring 50 is expanded, the lower cover 155 no longer completely overlaps the upper cover 160. These spring covers 155 and 160 protect the spring 50 from dirt and moisture and provide a pleasing aesthetic appearance. The covers 155 can be made from any durable material, such as fabric, plastic or metal.

Thus, the spring and stretcher system of the present invention improves the durability, safety, and ease of use of the umbrella 20. The user is able to open and to close a patio umbrella 20 without the use of a cord and pulley, and using a minimal amount of force. This spring and stretcher system is best applied for outdoor and patio umbrellas.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A patio umbrella comprising:

a pole;

a plurality of primary ribs extending from the pole, the plurality of primary ribs assuming an open position where the plurality of primary ribs are generally perpendicular to the pole, and assuming a closed position where the plurality of primary ribs are generally parallel to the pole;

a hub slidably supported on the pole;

a plurality of secondary ribs, each having a first end pivotally coupled to the hub and a second end pivotally coupled to one of the primary ribs;

a ledge positioned on the pole;

at least one stretcher having a first end pivotally coupled to one of the secondary ribs, and a second end pivotally coupled to the ledge;

a spring slidably supported on the pole between the hub and the ledge; and wherein the plurality of primary ribs are locked in the closed position based solely on positioning the at least one stretcher in a vertical orientation.

2. The umbrella of claim 1, wherein the vertical orientation of the at least one stretcher opposes the bias of the spring.

3. A patio umbrella comprising:

a pole;

a plurality of primary ribs extending from the pole;

a hub slidably supported on the pole;

a plurality of secondary ribs, each having a first end pivotally coupled to the hub and a second end pivotally coupled to one of the primary ribs;

a ledge positioned on the pole;

a spring slidably supported on the pole between the hub and the ledge; and a handle attached to the ledge.

4. The umbrella of claim 3, further including:

at least one sretcher having a first end pivotally coupled to one of the secondary ribs, and a second end pivotally coupled to the ledge.

5. The umbrella of claim 3, wherein the hub is a lower hub, further including an upper hub to which the plurality of primary ribs are coupled.

6. The umbrella of claim 4, wherein the ledge includes:

a plurality of spaced apart channels;

a connecting bar positioned inside each channel; and wherein the second end of a stretcher is pivotally supported by a corresponding connecting bar.

7. The umbrella of claim 4, wherein the ledge includes:

a base plate having a periphery, and a bore provided therethrough;

an annular wall provided above the base plate, with the pole slidably positioned through the bore and the annular wall; and a plurality of openings positioned adjacent the periphery of the base plate, with the second end of a stretcher pivotally supported at a corresponding opening.

8. The umbrella of claim 3, further including a cover that extends around the spring and a portion of the pole.

9. The umbrella of claim 8, wherein the cover is a first cover, and further including:

a second cover that extends around a portion of the spring and a portion of the pole, the second cover having a smaller diameter than that of the first cover, with the first cover slid over the second cover when the patio umbrella is in a non-deployed position.

10. A method of opening a patio umbrella, comprising:

a. providing a patio umbrella having a pole;

a plurality of primary ribs extending from the pole, each of the plurality of primary ribs having a bottom side;

a hub slidably supported on the pole;

a plurality of secondary ribs, each having a first end pivotally coupled to the hub and a second end pivotally coupled to one of the primary ribs;

a ledge positioned on the pole; and a spring slidably supported on the pole between the hub and the ledge, the spring being restrained from extension; and b. moving the secondary ribs radially outwardly solely by providing an upward force at the bottom side of one of the plurality of primary ribs to allow the bias of the spring to extend the spring.

11. The method of claim 10, wherein the restraint on the spring is removed by applying an upward force to a bottom side of one of the primary ribs.

12. A method of closing and locking a patio umbrella, comprising:

a. providing a patio umbrella having a pole;

a plurality of primary ribs extending from the pole;

a hub slidably supported on the pole;

a plurality of secondary ribs, each having a first end pivotally coupled to the hub and a second end pivotally coupled to one of the primary ribs;

a ledge positioned on the pole;

at least one stretcher having a first end pivotally coupled to one of the secondary ribs, and a second end pivotally coupled to the ledge; and a spring slidably supported on the pole between the hub and the ledge; and b. applying a downward force to one or more of the primary ribs to push the primary ribs vertically downward;

c. locking the primary ribs in a position that is generally parallel to the pole solely by positioning the stretchers in a generally vertical orientation to restrain the bias of the spring.

* * * * *